US007331880B2

(12) United States Patent
Rogers

(10) Patent No.: US 7,331,880 B2
(45) Date of Patent: Feb. 19, 2008

(54) SOCCER GOAL RETAINER

(75) Inventor: Brian Rogers, Hamden, NY (US)

(73) Assignee: Sportsfield Specialties, Inc., Delhi, NY (US)

( * ) Notice: Subject to any disclaimer, the term of this patent is extended or adjusted under 35 U.S.C. 154(b) by 269 days.

(21) Appl. No.: 11/135,175

(22) Filed: May 23, 2005

(65) Prior Publication Data

US 2006/0199674 A1 Sep. 7, 2006

Related U.S. Application Data

(60) Provisional application No. 60/659,125, filed on Mar. 7, 2005.

(51) Int. Cl.
*A63B 69/00* (2006.01)

(52) U.S. Cl. ..... 473/478

(58) Field of Classification Search ..... 473/478, 473/477, 476, 415; 273/400; 403/290, 23, 403/187, 266

See application file for complete search history.

(56) References Cited

U.S. PATENT DOCUMENTS

| | | | | |
|---|---|---|---|---|
| 949,066 | A * | 2/1910 | Fowler | 211/174 |
| 2,077,343 | A * | 4/1937 | Oakes et al. | 473/478 |
| 4,135,716 | A * | 1/1979 | Ginsburg | 473/416 |
| 4,188,742 | A * | 2/1980 | Oulman | 43/15 |
| 5,080,375 | A * | 1/1992 | Moosavi | 473/478 |
| 5,186,469 | A * | 2/1993 | Terris | 473/478 |
| 5,518,252 | A * | 5/1996 | Uhl | 273/400 |
| 5,553,863 | A * | 9/1996 | Wynne | 473/478 |
| 5,599,024 | A * | 2/1997 | Acuff et al. | 473/478 |
| 6,808,463 | B1 * | 10/2004 | Stockwell, III | 473/478 |
| 2006/0202426 | A1 * | 9/2006 | Tennett | 273/407 |

* cited by examiner

*Primary Examiner*—Eugene Kim
*Assistant Examiner*—M. Chambers
(74) *Attorney, Agent, or Firm*—Heslin Rothenberg Farley & Mesiti P.C.

(57) ABSTRACT

A Soccer Goal Retainer including an enclosure buried in the ground. A bar is mounted in the enclosure and rotates about its longitudinal axis. The bar is located toward the front wall and base of the enclosure. A clamp plate is mounted on the bar by hand bolts which engage threaded openings on the bar. The clamp plate includes a lower member which is secured to the bar. A vertical member extends at right angles from the lower member and an upper member extends from the vertical member generally at right angles remote from the lower member and away from the lower member. A lip extends generally at right angles from the upper member remote from the vertical member toward the lower member. With the vertical member generally positioned vertically, the lip, the upper member and vertical member are placed over the rear rail of a soccer goal and the clamp plate is secured to the bar. The clamp plate is released from the rear rail by loosening the clamp plate from the bar. The clamp plate and the bar are then rotated in a forward manner and downwardly into the enclosure. A cover is placed over the enclosure both when the clamp plate is in use and when it is being stored.

28 Claims, 10 Drawing Sheets

SOCCER GOAL RETAINER

CROSS-REFERENCES TO RELATED APPLICATIONS

This patent application claims the benefit of an earlier filing date under 35 USC 119(e) of a provisional patent application, filed in the United States Patent and Trademark Office on Mar. 7, 2005, and entitled SOCCER GOAL RETAINER and being Provisional Application No. 60/659,125.

FIELD OF THE INVENTION

This invention relates to retaining devices and more particularly to a retaining device for securing a soccer goal.

PRIOR ART

In the game of soccer a three sided goal is used which is constructed with a frame having a net. In the days of natural turf, it was accepted practice to stake the base of the soccer goal into the ground. Today, with the increased use of artificial turf, staking the soccer goal is impossible. Unfortunately, particularly with school age players, the players on occasion, climb on the soccer goal causing it to topple over. The soccer goal, which has a steel frame, only too frequently strikes a player causing injury and even death.

It is essential to develop a soccer goal retainer which holds the soccer goal securely in place and which can be readily released by field staff when the soccer goal is removed. Since many fields used for soccer are also used for football, it would also be desirable to have at least one embodiment of the invention which would be merged with the single support post of a football goal. To date no such device is known to exist for a soccer goal on artificial turf.

OBJECTS

Therefore, it is an object of this invention to provide a retainer for securing a soccer goal post in place even on artificial turf.

It is another object of this invention to provide a retainer for a soccer goal which can be used with artificial turf.

It is another object of this invention to provide a retainer for a soccer goal which can be used in conjunction with a single post.

It is another object of this invention to provide a retainer for a soccer goal that is dependable and economical.

SUMMARY OF THE INVENTION

A Soccer Goal Retainer is provided for securing a soccer goal. An enclosure includes a bar mounted to rotate about its longitudinal axis within the enclosure. A retainer plate is removably affixed to the bar. The retainer plate and the bar are rotatable to a position to secure the soccer goal with the retainer plate being generally in a vertical position and extending outside the enclosure and being rotatable from the vertical position into the enclosure. A cover is further provided over the enclosure.

BRIEF DESCRIPTION OF THE NUMERALS

| NUMERAL | DESCRIPTION |
|---|---|
| 21 | soccer goal |
| 23 | football goal |
| 25 | support post |
| 27 | frame (soccer goal) |
| 29 | net |
| 31 | cage |
| 33 | open front |
| 35 | enclosure |
| 37 | front wall |
| 39 | rear wall |
| 41 | side walls |
| 43 | base |
| 45 | concrete |
| 47 | legs |
| 49 | bar |
| 51 | ends |
| 52 | shaft and journal combination |
| 53 | threaded openings |

-continued

| NUMERAL | DESCRIPTION |
|---|---|
| 55 | hand bolts |
| 57 | knob |
| 59 | upper end |
| 61 | clamp plate |
| 63 | open center |
| 65 | lower member |
| 67 | vertical member |
| 69 | upper member |
| 71 | lip |
| 72 | retainer |
| 73 | left section |
| 75 | right section |
| 77 | rear rail |
| 79 | openings |
| 81 | ledge |
| 83 | top edge |
| 85 | artificial turf |
| 87 | strip |
| 89 | bolts |
| 91 | nuts |
| 93 | cover |
| 94 | sections |
| 95 | board |
| 97 | sheet |
| 98 | cover bolts |
| 99 | front section |
| 101 | rear section |
| 105 | slots |
| 107 | stand alone clamp plate |
| 108 | stand alone vertical member |
| 109 | stand alone cover |
| 111 | guide slot |
| 112 | guide bolt |
| 113 | stand-alone upper member |
| 114 | stand-alone upper lip |
| 115 | stand-alone retainer |
| 116 | guide blocks |

Detailed Description of the Preferred Embodiment

The Soccer Goal Retainer has two similar embodiments. Often, but not always, a soccer goal which requires the security of the Soccer Goal Retainer is placed on a sports field directly in front of a football goal post. This requires a Soccer Goal Retainer which accommodates the post of the football goal. In other situations, the soccer field is exclusively used for a soccer field or at least does not include a football goal and the post of a football goal need not be accommodated. Each embodiment will be considered separately. However, where a part is the same and functions in the same manner, the same numeral will be used to identify that part in both versions. Where the part has differences or functions differently, a separate numeral will be used

Embodiment Incorporating the Post of a Football Goal

This embodiment of the retaining device, which incorporates the post of a football goal is shown in FIGS. 1 through 7.

Figure 1:
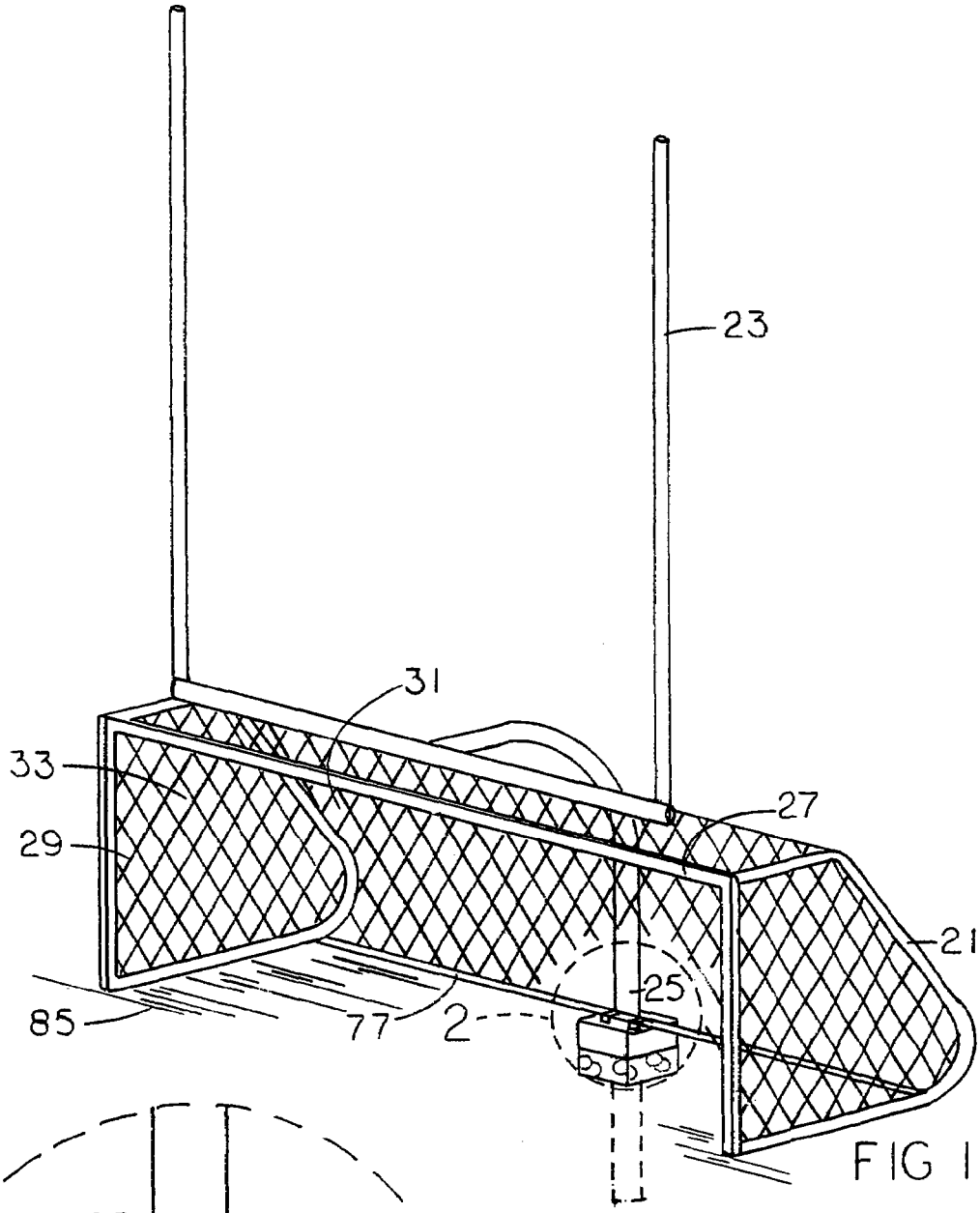
FIG. 1 is a pictorial view of the Soccer Goal Retainer used in conjunction with a football goal post for securing a soccer goal post in the ground.
Figure 2:
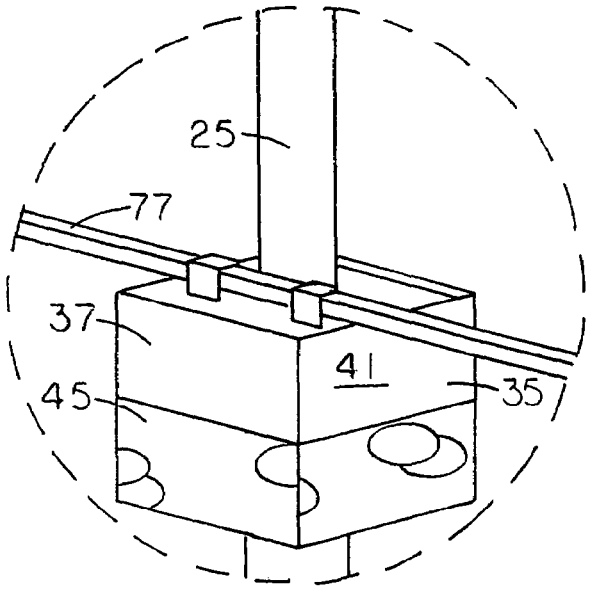
FIG. 2 is an enlarged perspective view of the Soccer Goal Retainer shown in FIG. 1 with the football goal post both above and below the ground with the clamp plate as two retainers extending through the cover.

As seen in FIG. 1, a soccer goal 21 is shown in front of a football goal 23 having a support post. The soccer goal 21 includes a frame 27 covered by a net 29 to form a cage 36 with an open front 33. The support post 25 of the football goal 23 extends through an enclosure 35. The enclosure 35 has a front wall 37 and a rear wall 39 and two side walls 41 and a base 43. The entire enclosure 35 is located in the ground. The football goal 23 extends further into the ground beneath the enclosure 31.

The enclosure 35 is mounted on concrete 45. Legs 47, (FIGS. 2 and 3), extend from each corner of the base 43 of the enclosure 35 into the concrete 45 for added stability.

A bar 49 is mounted within the enclosure 35 just above the base 43 of the enclosure 35 to rotate on its ends 51. The bar 49 is mounted by a shaft and journal combination 52 so as to rotate about its longitudinal axis. The bar 49 is also located toward the front wall 37 and between the support post 25 and the front wall 37. Threaded openings 53 are provided symmetrically in the bar 49 and hand bolts 55, each with a knob 57 at the upper end 59, are threaded into the threaded openings 53 in the bar 49. A clamp plate 61 is secured to the bar 49 by the bolts 55. The clamp plate 61 of the embodiment with a football goal 23 has an open center 63 to permit movement of the clamp plate 61 despite the football goal 23 that extends through the enclosure 31.

The clamp plate 61 has four sections. The four sections include a lower member 65 which rests on the bar 49, a vertical member 67 which extends vertically from the lower member 65 and an upper member 69 which extends horizontally from the vertical member 67 remote from the lower member 65. A lip 71 extends vertically from the upper member 69 at the edge of the upper member 69 remote from the member 67 for a short distance generally parallel to the vertical member 67 downwardly back toward the lower member 65 but on the opposite side of the vertical member 67 from the lower member 65. The vertical member 67 the upper member 69 and the lip 71 form a retainer 72 that is an inverted U-shape. The vertical member 67 of the clamp plate 61 is larger than the lower member 65, the upper member 69 and the lip 71.

The vertical member 67 of the clamp plate 61 has an opening 70 in its center just above the lower member 65 and extends through the upper member 69 and the lip 71 hereby forming a left section 73 and a right section 75 of the retainer 72 so that the support post 25 will not prevent the clamp plate 61 from being rotated downwardly into the enclosure 35.

The soccer goal 21 has a rear rail 77 which is gripped by the retainer 72 including the vertical member 67, upper member 69 and the lip 71. The lower member 65 includes a pair of openings 79 through which the hand bolts 55 extend. The hand bolts 55 are threaded into the threaded openings 53 of the bar 49 which rotates at its ends 51.

A ledge 81 is secured to the side walls 41 of the enclosure 35 just below a top edge 83 of the enclosure 35. Artificial turf 85 used on the field is secured to the ledge 81 by strips 87 held in place by bolts 89 and nuts 91. A cover 93 which is in two sections 94 in this embodiment which includes a football goal 23, fits on each side of the support post 25 for the football goal 23. Each section 94 section of the cover 93 a board 95 with a sheet 97, usually aluminum, secured to the bottom of the board 95 and clamping the artificial turf between the board 95 and the sheet 97 to secure the piece of artificial turf onto the cover 93. The sheet 97 is secured to the board 95 by cover bolts 98. The two sections 94 include a front section 99 and a rear section 101. The front section 99 borders on the front wall 37 and side walls 41 of the enclosure 35 while the rear section 101 borders of the rear wall 39 and the side walls 41 of the enclosure 35.

With the front section 99 of the cover 93 removed the retainer 72 is placed over the rear rail 77 of the frame 27. The bolts 55 are turned down into the bar 49 by turning the knobs 57. By tightening the hand bolts 55, the lower member 65 is secured to the bar 49 with the retainer 72 placed over the rear rail 77 of the frame 27. By firmly gripping the rear rail 77 of the frame 27 of the soccer goal 21, the entire soccer goal 21 is securely and safely held in place. The cover 93 includes slots 105 to permit the clamp plate 61 to extend through it. The front section 99 is then returned to its place on the enclosure 35.

Figure 3:
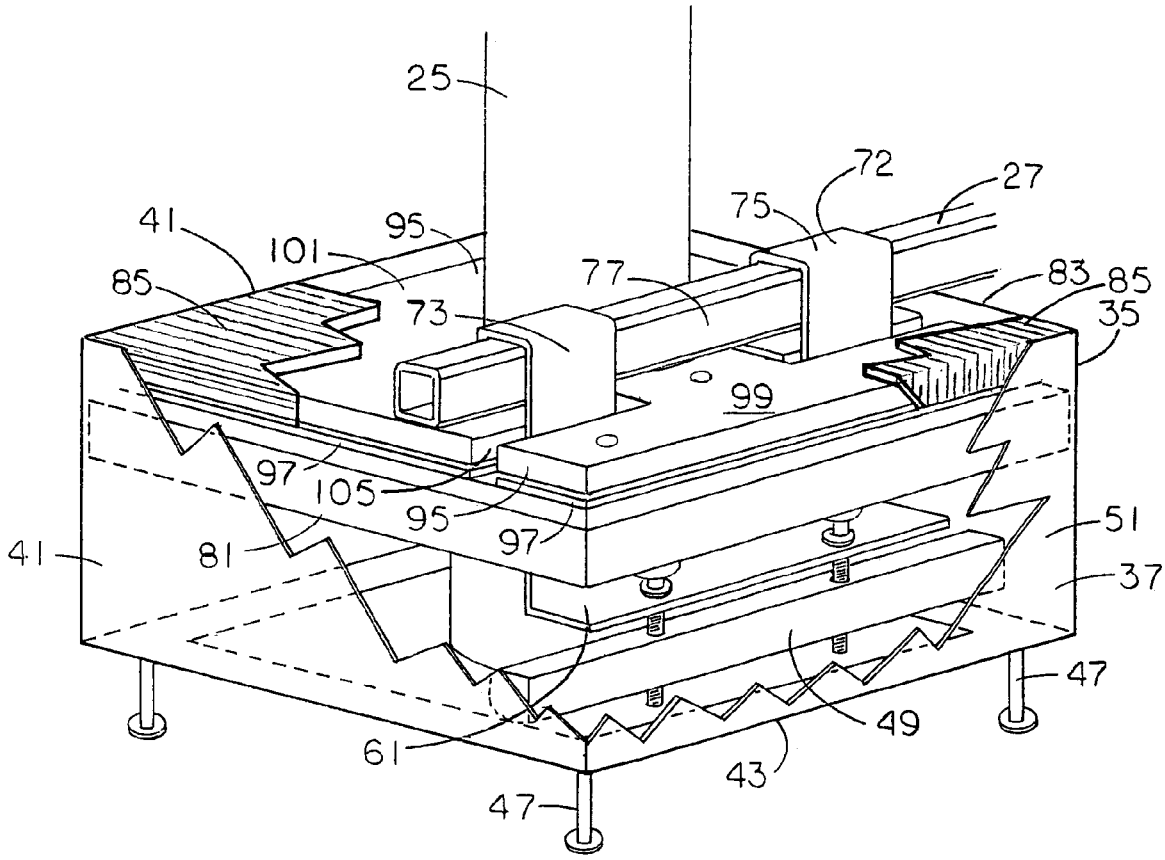
FIG. 3 is a perspective view of the Soccer Goal Retainer with the front and one side broken away showing the clamp retainer holding down the rear rail of a soccer goal with the football goal extending through the cover on the enclosure of the Soccer Goal Retainer.
Figure 4:
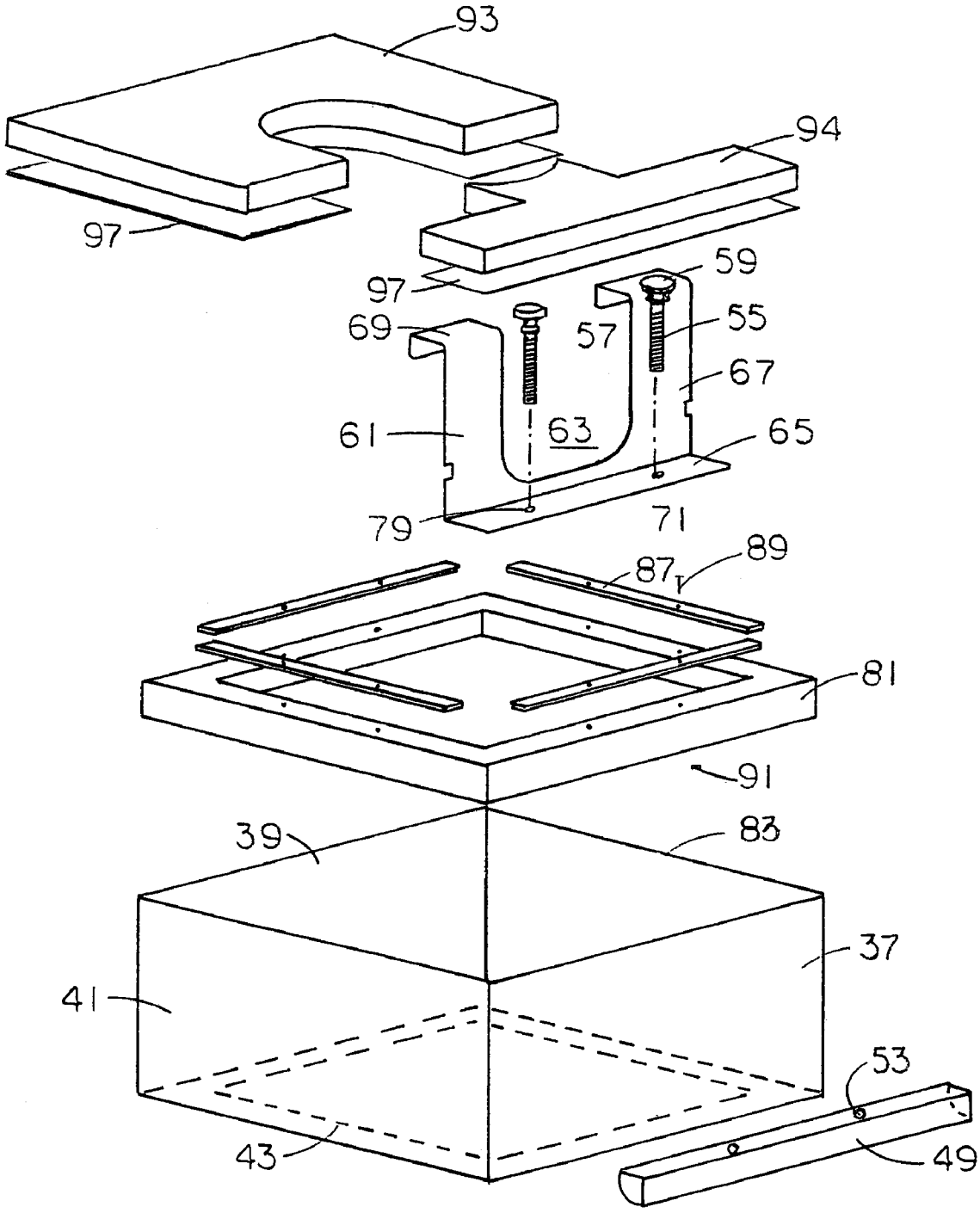
FIG. 4 is an exploded perspective view of the Soccer Goal Retainer for use with a football goal.
Figure 5:
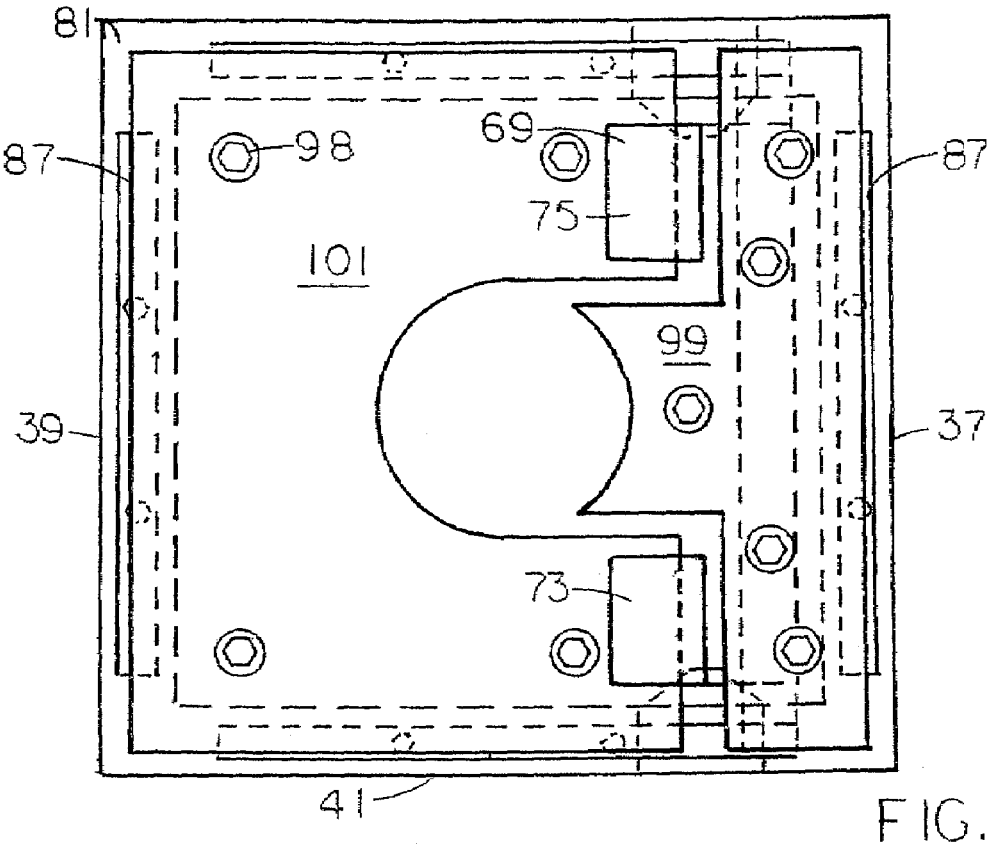
FIG. 5 is a plan view of the Soccer Goal Retainer for the use with a football goal showing the opening for the football goal post and showing the bar for rotating the clamp plate and with the interior parts in broken lines.
Figure 6A:
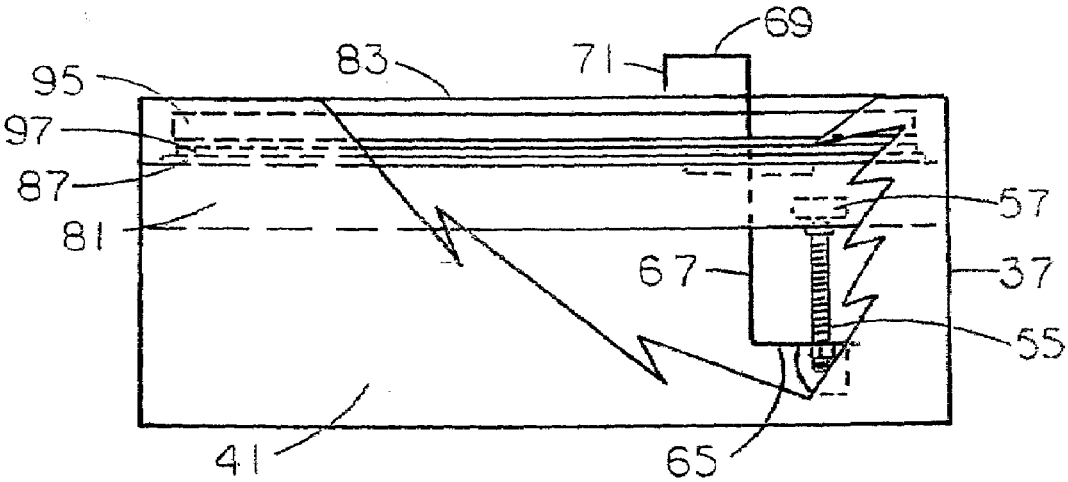
FIG. 6A is a side elevation of the Soccer Goal Retainer partially broken away showing the clamp plate extending up out of the cover plate and the bar and bolts to secure the clamp plate to the bar.
Figure 6B:
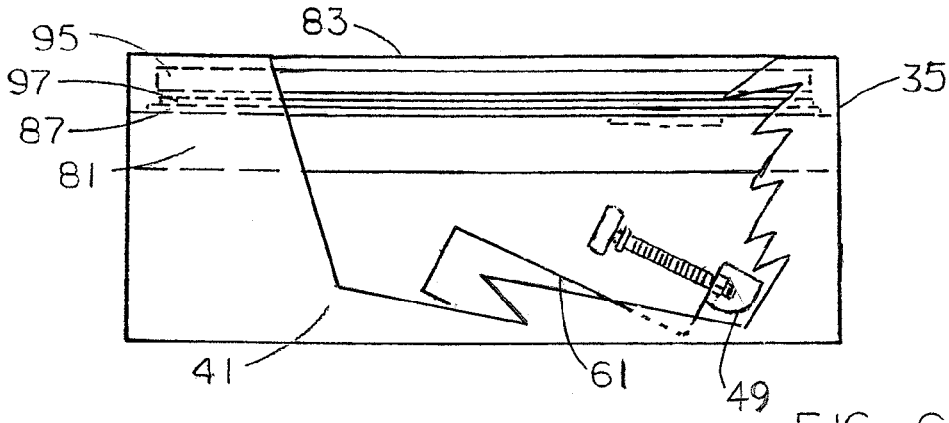
FIG. 6B is a side elevation of the Soccer Goal Retainer partially broken away showing the clamp plate in a lowered or retracted position within the Soccer Goal Retainer.
Figure 7:
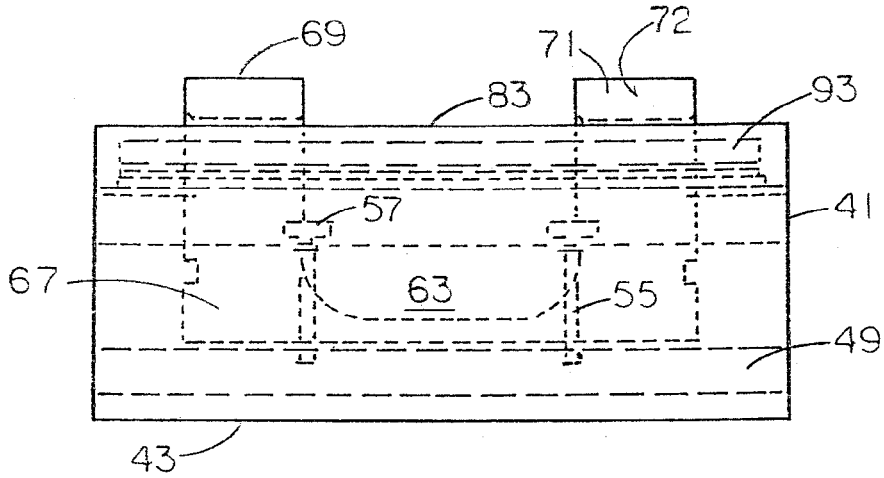
FIG. 7 is a front elevation of the Soccer Goal Retainer with the clamp plate extending through the cover and showing in broken lines the clamp plate, bar and bolts within the retaining device.
Figure 8:
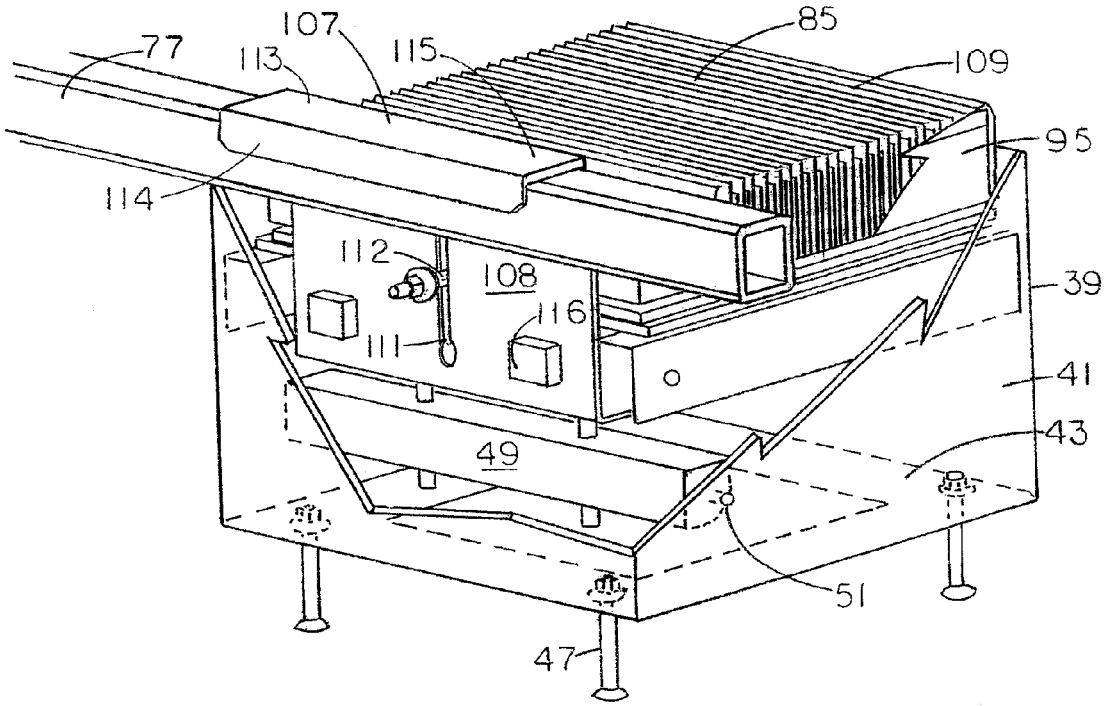
FIG. 8 is a perspective view of the front and side of the stand-alone version of the Soccer Goal Retainer without a football goal with the front and side broken away and showing the bar, clamp plate and bolts with the clamp plate retaining a portion of the rear rail of a soccer goal.
Figure 9:
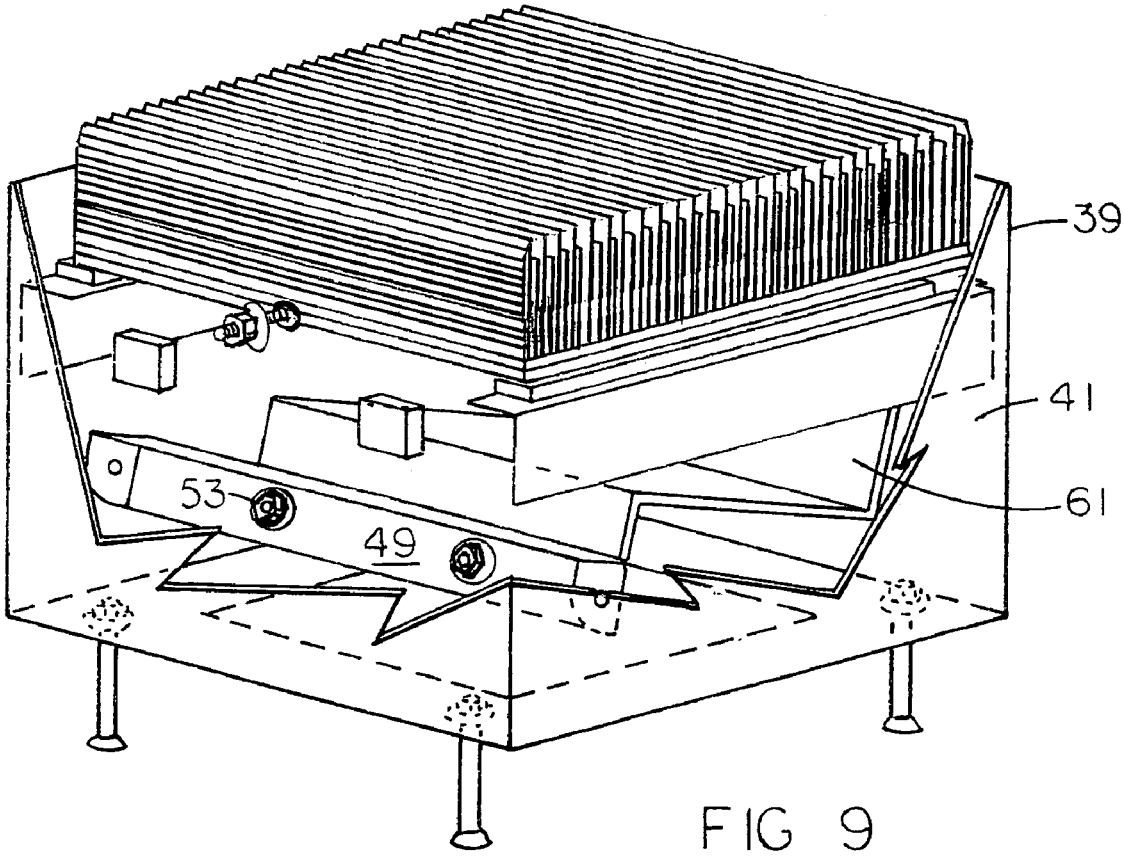
FIG. 9 is a perspective view similar to FIG. 8 with the front and side broken away with the clamp plate retracted within the Soccer Goal Retainer.

The rotation of the bar 49, permits the clamp plate 61 to rotate out of the enclosure 35 to retain the soccer goal 21 and to be placed back into the enclosure 35 as shown in FIG. 6B. As seen in FIG. 3, with the Soccer Goal Retainer, the clamp plate 61 is located with the vertical member 67 (FIGS. 3 and 4) adjacent and parallel to the front wall 37 and slightly toward the rear wall 39.

To remove the soccer goal 21, the front section 99 of the cover 93 is removed. The hand bolts 55 are loosened and the retainer 72 clamp plate 61 is lifted off the rear rail 77 of the soccer goal 21 and tilted forward to the rear wall 39 of the enclosure 35 and below the level of the cover 93 which is then replaced. When the clamp plate 47 is tilted backwardly toward the rear wall 39 the bar 49 rotates with it.

Stand-Alone Embodiment

The embodiment of the Soccer Goal Retainer for use with a soccer goal 21 when no football goal 23 is present is substantially the same as that already described. Thus, the embodiment already described is incorporated herein subject to specific matters which are different. The numerals used are the same except as to parts which are not at least closely identical.

In the stand-alone embodiment, the stand-alone clamp plate 107 is a solid plate as there is no need that the center of the stand-alone clamp plate 107 be cut out to permit the stand-alone clamp plate 107 to rotate downwardly since there is no support post 25. A stand-alone retainer cover 109 is in one piece as the absence of the support post 25 permits the enclosure 35 to be covered by the stand-alone cover 109 that is in one piece.

Also, on the stand-alone embodiment, the stand-alone clamp plate 107 is placed on the bar 49 in the opposite direction to that used with a support post 23. The stand-alone clamp plate 107 as seen in FIG. 6, has a solid vertical member 109 and is not cut out as is the clamp plate 61 used with a football goal 23.

Figure 10:
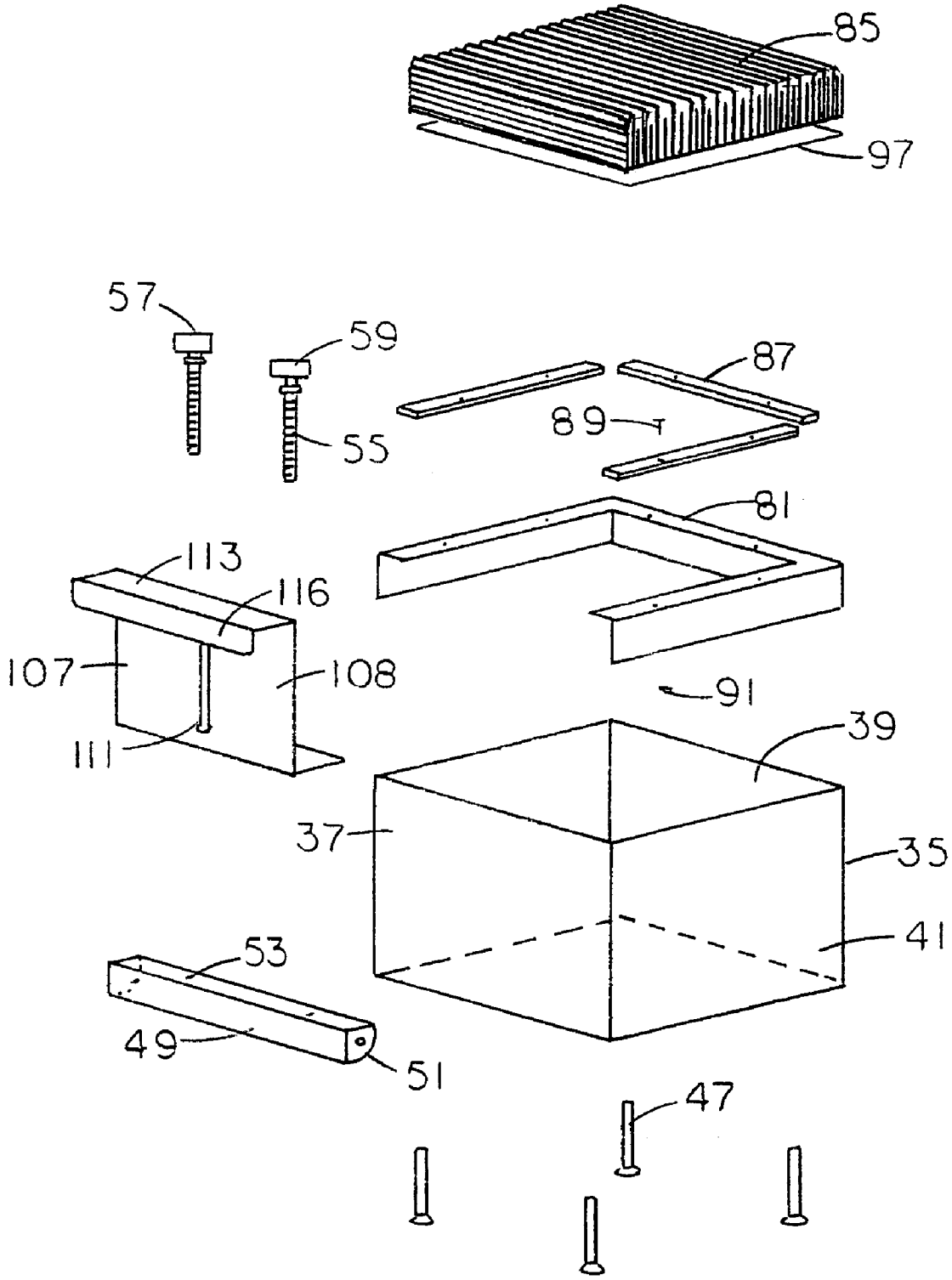
FIG. 10 is an exploded view of a stand alone version of the Soccer Goal Retainer.
Figure 11:
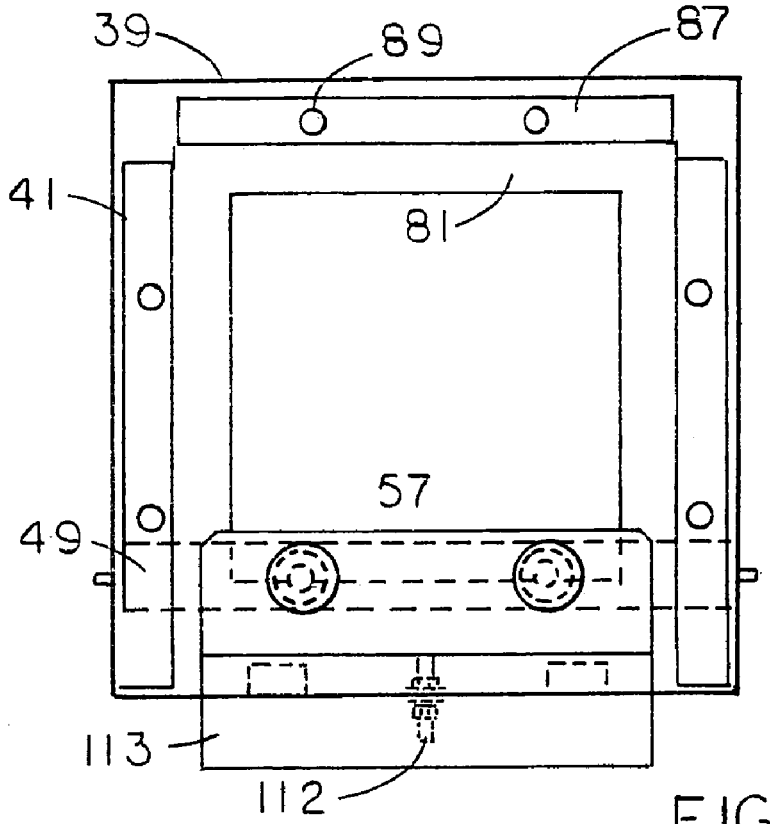
FIG. 11 is a plan view of the stand alone version of the Soccer Goal Retainer with the cover removed.
Figure 12:
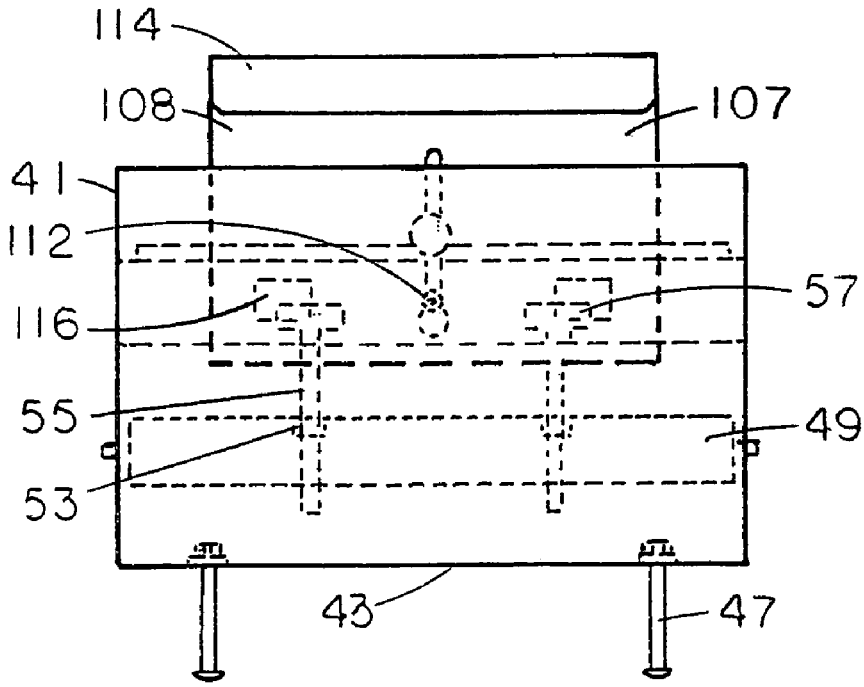
FIG. 12 is a front elevation of the stand alone version of the Soccer Goal Retainer showing the interior operation in broken lines.
Figure 13:
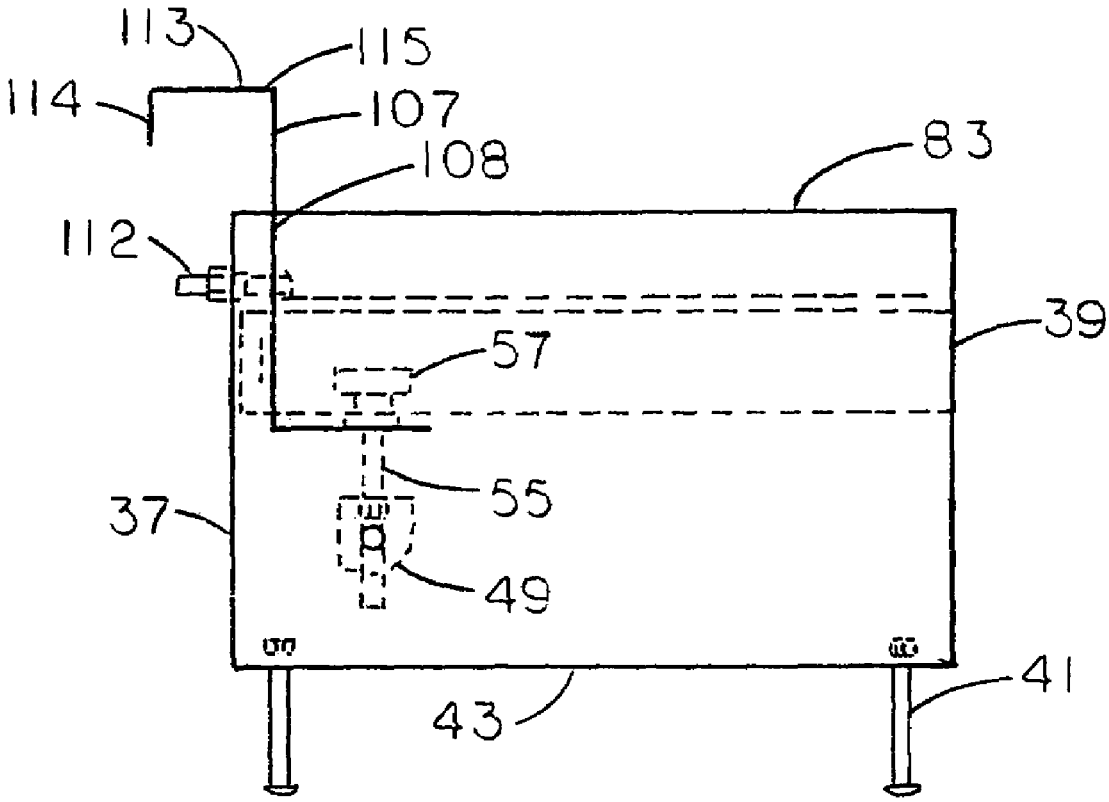
FIG. 13 is a side elevation of the stand alone version of the Soccer Goal Retainer with the interior parts in broken lines.

However, the vertical member 109 does have a guide slot 111 which is a vertical slot as seen in FIGS. 10 and 12. A guide bolt 112 is secured to the front wall 37. The guide bolt 112 fits through the guide slot 111 and retains the stand-alone clamp plate 107 in proper alignment. Similarly, a stand-alone upper member 113 and a stand-alone upper lip 114 are in one piece forming a stand-alone retainer 15 that is in one piece.

The enclosure 35 has the same legs 47 and includes the same front wall 37, rear wall 39, side walls 41, and base 43. The bar 49 in the same manner except, as previously described, the stand-alone clamp plate 107 faces in the opposite direction.

Guide blocks 116 are mounted on the inside of the front wall 37 and are generally located symetrically on opposite sides of the guide slot 111.

To use the stand-alone embodiment of the Soccer Goal Retainer, the stand-alone clamp plate 107 is rotated to place the stand-alone vertical member 108 in a vertical position. The stand-alone clamp plate 107 secures the rear base rail 77 of the soccer goal 2. The stand-alone cover 109 is placed on the enclosure 35. The stand-alone clamp plate 107 extends vertically within the enclosure 35 closely adjacent to the front wall 37. A stand-alone cover 107 is slightly recessed from the front wall 37 to provide a space for the stand-alone vertical member 108 to extend. The stand-alone cover 109 is constructed in the same manner as the cover 93 used with a football goal 23, namely a board 95 with a sheet 97 that retains a piece of artificial turf 85 over the cover 93.

It is to be understood that the drawings and the description matter are in all cases to be interpreted as merely illustrative of the principles of the invention rather than as limiting the same in any one way since it is contemplated that various changes may be made in various elements to achieve like results without departing from the spirit of the invention or scope of the appended claims.

The invention claimed is:

1. A Soccer Goal Retainer for securing a soccer goal comprising:
   - an enclosure;
   - a bar having a longitudinal axis and mounted to rotate about its longitudinal axis within the enclosure;
   - a clamp plate for releasably engaging the soccer goal;
   - means for removably securing the clamp plate to the bar;
   - the clamp plate and the bar being rotatable to a position with a portion of the clamp plate extending outside the enclosure generally in a vertical position; and
   - a cover for the enclosure.

2. A Soccer Goal Retainer according to claim 1 wherein the bar has a rectangular cross section.

3. A Soccer Goal Retainer according to claim 1 wherein the bar includes a pair of threaded openings.

4. A Soccer Goal Retainer according to claim 1 wherein the bar has a rectangular cross section and includes a pair of threaded openings, the threaded openings being located substantially symmetrically on the bar.

5. A Soccer Goal Retainer according to claim 1 wherein the clamp plate includes a lower member, a vertical member extending generally at right angles to the lower member, an upper member which extends generally at right angles from the vertical member remote from the lower member and away from the lower member and a lip extending generally at right angles from the upper member remote from the vertical member and extending toward the lower member.

6. A Soccer Goal Retainer according to claim 1 further including legs extending from the enclosure.

7. A Soccer Goal Retainer according to claim 1 wherein the clamp plate comprises a cutout to allow the clamp plate to rotate downwardly and around a support post of a football goal.

8. A Soccer Goal Retainer according to claim 7 wherein the cover comprises a cutout to allow the cover fit around a support post of a football goal.

9. A Soccer Goal Retainer according to claim 1 wherein the cover comprises a generally solid cover.

10. A Soccer Goal Retainer for securing a soccer goal comprising:
   - An an enclosure having a front wall, a rear wall, two side walls, and a base;
   - a bar mounted to rotate within the enclosure;
   - a clamp plate including a lower member, a vertical member extending generally at right angles to the lower member, an upper member which extends generally at right angles form from the vertical member remote from the lower member and away from the lower member and a lip extending generally at right angles from the upper member remote from the vertical member and extending toward the lower member;
   - means for securing the lower member to the bar;
   - a cover for the enclosure; and
   - means for supporting the cover.

11. A Soccer Goal Retainer according to claim 10 wherein the bar is located toward the front wall and the base.

12. A Soccer Goal Retainer according to claim 10 wherein the bar has a pair of openings in it, each of the openings in the bar being threaded.

13. A Soccer Goal Retainer according to claim 10 wherein:

the bar has a pair of openings in it, each of the openings in the bar being threaded; and the lower member has a pair of openings extending through it, aligned with the pair of openings in the bar.

14. A Soccer Goal Retainer according to claim 10 wherein the means for supporting the cover with a pair of bolts to secure the lower member to the bar, is a ledge mounted on the side walls and rear wall.

15. A Soccer Goal Retainer according to claim 10 wherein the vertical member of the clamp plate is larger than the lower member and the upper member.

16. A Soccer Goal Retainer according to claim 10 including legs extending from the base.

17. A Soccer Goal Retainer according to claim 10 wherein the bar has a rectangular cross section.

18. A Soccer Goal Retainer according to claim 10 wherein the cover includes a board with a plate on one side and with artificial turf covering the opposite side of the board from the plate, the artificial turf being secured between the plate and the board.

19. A Soccer Goal Retainer according to claim 10 wherein the clamp plate comprises a cutout to allow the clamp plate to rotate downwardly and around a support post of a football goal.

20. A Soccer Goal Retainer according to claim 19 wherein the cover comprises a cutout to allow the cover fit around a support post of a football goal.

21. A Soccer Goal Retainer according to claim 10 wherein the cover comprises a generally solid cover.

22. A Soccer Goal Retainer for securing a soccer goal comprising:

an enclosure having a rectangular configuration and having a front wall, a rear wall, two side walls and a base, the two side walls, and the front and rear wall each having a top edge remote from the base; a journal mounted on each side wall adjacent to the base and front wall;

the base having four corners;

a bar having a rectangular cross section and having a shaft extending from each end of the bar, each shaft being mounted to rotate in one of the journals, the bar having a pair of openings in it, each opening of the pair of openings being threaded;

a clamp plate including a lower member, a vertical member extending generally at right angles to the lower member, an upper member which extends generally at right angles from the vertical member remote from the lower member and away from the lower member and a lip extending generally at right angles from the upper member remote from the vertical member and extending through it and aligned with the pair of openings in the bar;

a pair of bolts to secure the lower member to the bar, the clamp plate and bar being rotatable to a stored position within the enclosure and to an operational position with the vertical member being generally substantially parallel to the front wall and extending outside the enclosure;

a cover; and means to support the cover.

23. A Soccer Goal Retainer according to claim 22 further including legs extending from the enclosure.

24. A Soccer Goal Retainer according to claim 22 wherein the means to support the cover includes a ledge mounted on the side walls and the rear wall slightly below the top edge of the two side walls and the rear walls.

25. A Soccer Goal Retainer according to claim 22 wherein the cover includes a board with two sides and with a sheet on one side and with artificial turf covering the board on the side remote from the sheet.

26. A Soccer Goal Retainer according to claim 22 wherein the clamp plate comprises a cutout to allow the clamp plate to rotate downwardly and around a support post of a football goal.

27. A Soccer Goal Retainer according to claim 26 wherein the cover comprises a cutout to allow the cover fit around a support post of a football goal.

28. A Soccer Goal Retainer according to claim 22 wherein the cover comprises a generally solid cover.

* * * * *

UNITED STATES PATENT AND TRADEMARK OFFICE

CERTIFICATE OF CORRECTION

PATENT NO. : 7,331,880 B2
APPLICATION NO. : 11/135175
DATED : February 19, 2008
INVENTOR(S) : Rogers It is certified that error appears in the above-identified patent and that said Letters Patent is hereby corrected as shown below:

Col. 6, Claim 1, Lines 1 & 2: Delete "A Soccer Goal Retainer for securing a soccer goal comprising:" and insert
-- A Soccer Goal Retainer in combination with a soccer goal, said retainer comprising: --

Col. 6, Claim 10, Lines 1 & 2: Delete "A Soccer Goal Retainer for securing a soccer goal comprising:" and insert
-- A Soccer Goal Retainer in combination with a soccer goal, said retainer comprising: --

Col. 7, Claim 22, Lines 1 & 2: Delete "A Soccer Goal Retainer for securing a soccer goal comprising:" and insert
-- A Soccer Goal Retainer in combination with a soccer goal, said retainer comprising: --

Signed and Sealed this

Twenty-fifth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,331,880 B2
APPLICATION NO. : 11/135175
DATED : February 19, 2008
INVENTOR(S) : Rogers It is certified that error appears in the above-identified patent and that said Letters Patent is hereby corrected as shown below:

Col. 6, Claim 1, Lines 13 & 14: Delete "A Soccer Goal Retainer for securing a soccer goal comprising:" and insert
-- A Soccer Goal Retainer in combination with a soccer goal, said retainer comprising: --

Col. 6, Claim 10, Lines 52 & 53: Delete "A Soccer Goal Retainer for securing a soccer goal comprising:" and insert
-- A Soccer Goal Retainer in combination with a soccer goal, said retainer comprising: --

Col. 7, Claim 22, Lines 37 & 38: Delete "A Soccer Goal Retainer for securing a soccer goal comprising:" and insert
-- A Soccer Goal Retainer in combination with a soccer goal, said retainer comprising: --

This certificate supersedes the Certificate of Correction issued May 25, 2010.

Signed and Sealed this

Twenty-second Day of June, 2010

David J. Kappos

David J. Kappos
*Director of the United States Patent and Trademark Office*